US009078058B2

(12) United States Patent
Jochelson

(10) Patent No.: US 9,078,058 B2
(45) Date of Patent: Jul. 7, 2015

(54) APPLICATIONS FOR A TWO-WAY WIRELESS SPEAKER SYSTEM

(75) Inventor: Daniel S. Jochelson, Richardson, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 971 days.

(21) Appl. No.: 12/361,643

(22) Filed: Jan. 29, 2009

(65) Prior Publication Data

US 2010/0188212 A1 Jul. 29, 2010

(51) Int. Cl.

| | |
|---|---|
| ***G08B 21/00*** | (2006.01) |
| ***H04R 5/00*** | (2006.01) |
| ***H04R 5/02*** | (2006.01) |
| ***H04R 5/04*** | (2006.01) |

(52) U.S. Cl.

CPC ... *H04R 5/02* (2013.01); *H04R 5/04* (2013.01)

(58) Field of Classification Search

USPC ..... 381/79, 311, 2, 3, 4, 56; 455/569; 340/539.15, 573.4

See application file for complete search history.

(56) References Cited

U.S. PATENT DOCUMENTS

| | | | | |
|---|---|---|---|---|
| 6,385,322 | B1 * | 5/2002 | Mietling | 381/82 |
| 6,466,832 | B1 * | 10/2002 | Zuqert et al. | 700/94 |
| 6,487,296 | B1 * | 11/2002 | Allen et al. | 381/80 |
| 7,031,476 | B1 * | 4/2006 | Chrisop et al. | 381/77 |
| 7,049,968 | B2 * | 5/2006 | Fitzgerald et al. | 340/573.1 |
| 7,427,921 | B2 * | 9/2008 | Van Woudenberg | 340/573.1 |
| 7,697,891 | B2 * | 4/2010 | Desrosiers et al. | 455/39 |
| 7,774,032 | B2 * | 8/2010 | Swan et al. | 455/575.3 |
| 8,050,203 | B2 * | 11/2011 | Jacobsen et al. | 370/310 |
| 8,131,390 | B2 * | 3/2012 | Braithwaite et al. | 700/94 |
| 2001/0008415 | A1 * | 7/2001 | Park | 348/143 |
| 2003/0013503 | A1 * | 1/2003 | Menard et al. | 455/569 |
| 2003/0040910 | A1 * | 2/2003 | Bruwer | 704/266 |
| 2003/0159075 | A1 * | 8/2003 | Miyazaki | 713/300 |
| 2005/0123143 | A1 * | 6/2005 | Platzer et al. | 381/2 |
| 2006/0120335 | A1 * | 6/2006 | Teng et al. | 370/338 |
| 2006/0139449 | A1 * | 6/2006 | Cheng et al. | 348/61 |
| 2006/0153155 | A1 * | 7/2006 | Jacobsen et al. | 370/338 |
| 2006/0161282 | A1 * | 7/2006 | Chung | 700/94 |
| 2006/0269084 | A1 * | 11/2006 | Yamaguchi et al. | 381/111 |
| 2006/0287745 | A1 * | 12/2006 | Richenstein et al. | 700/94 |
| 2007/0030986 | A1 * | 2/2007 | McArthur et al. | 381/311 |
| 2008/0025324 | A1 * | 1/2008 | Sawada | 370/400 |
| 2008/0063216 | A1 * | 3/2008 | Sakata et al. | 381/80 |
| 2008/0186171 | A1 * | 8/2008 | Gates | 340/541 |
| 2008/0189397 | A1 * | 8/2008 | Atkinson et al. | 709/221 |
| 2008/0197716 | A1 * | 8/2008 | Rubio et al. | 307/128 |
| 2008/0199020 | A1 * | 8/2008 | Suzuki | 381/77 |
| 2009/0110216 | A1 * | 4/2009 | Tschirpke | 381/120 |

FOREIGN PATENT DOCUMENTS

EP 0586075 A1 * 3/1999

* cited by examiner

*Primary Examiner* — Davetta W Goins
*Assistant Examiner* — Kuassi Ganmavo
(74) *Attorney, Agent, or Firm* — Robert D. Marshall, Jr.; Frank D. Cimino

(57) ABSTRACT

The two-way wireless speaker system of this invention increases sound fidelity by enabling speakers to acknowledge receipt of audio data packets. This provides increased functionality because the audio hub can receive data not only from wired inputs, but also wireless transmission from computer, cell phone, and other sources. Audio hub can use information from speaker to customize/adjust audio signal for each speaker independently, giving better audio quality and synchronization among speakers.

14 Claims, 7 Drawing Sheets

APPLICATIONS FOR A TWO-WAY WIRELESS SPEAKER SYSTEM

TECHNICAL FIELD OF THE INVENTION

The technical field of this invention is wireless speaker systems.

BACKGROUND OF THE INVENTION

With surround sound systems in many homes, long wires have created problems for the end consumer. Wires create an unattractive environment and a safety risk. Manufacturers of speaker systems have sought to solve this problem by introducing wireless speaker systems. Initial attempts involved one-way transmission to the speakers of a 900 MHz signal, which can interfere with cordless telephones and other devices in this frequency range. Other solutions include one-way transmission of an audio signal to the speakers via infrared or over power lines in the walls. Most systems send extra control and error correction data on the one-way channel to improve quality of service, since reception of all the data is critical in audio applications. Most wireless speaker systems use a broadcast model for one-way transmission.

FIG. 1 illustrates a conventional one-way wireless speaker system. Digital audio content 101 can come from a CD player or other audio source and is passed to the audio hub 102 where it is split into six components: left; right; center; rear left; rear right; and subwoofer. The wireless transmitter 103 modulates six separate carrier signals with the digital audio information. The six one-way broadcast signals 104 contain player content and reader identification. One-way broadcasts are sent to all channels with each receiver 111 through 116 extracting the broadcast signals. Demodulation is accomplished in blocks 121 through 126 with audio signals as outputs for each speaker channel. Blocks 131 through 136 perform audio signal processing for presentation to the respective speakers.

Frequency hopping is employed at the transmitter allowing the receiver to extract from an individual frequency or alternately every speaker receives the entire signal and parses/extracts its channel. One-way transmission necessitates error correction processing at the receiver using the redundancy introduced into the transmitted signal.

SUMMARY OF THE INVENTION

The two-way wireless speaker system of this invention increases fidelity of the sound. Speakers can acknowledge receipt of audio data packets. This provides increased functionality because the audio hub can receive data not only from wired inputs, but also wireless transmission from computers, cell phones and other sources. The audio hub can use information from the speakers to customize/adjust the audio signal for each speaker independently and also achieve better synchronization among the speakers.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
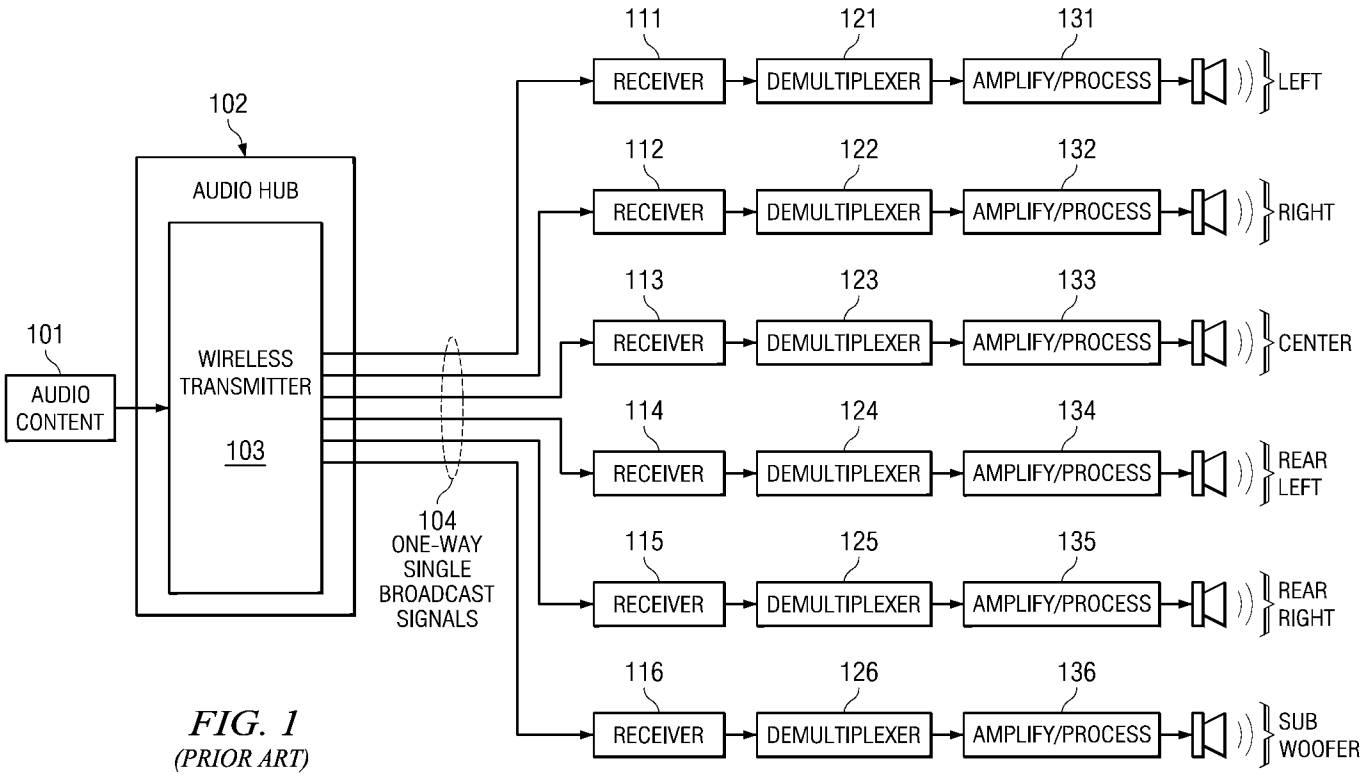
FIG. 1 (PRIOR ART)
FIG. 1 illustrates a conventional one-way wireless speaker system (Prior Art)
Figure 2:
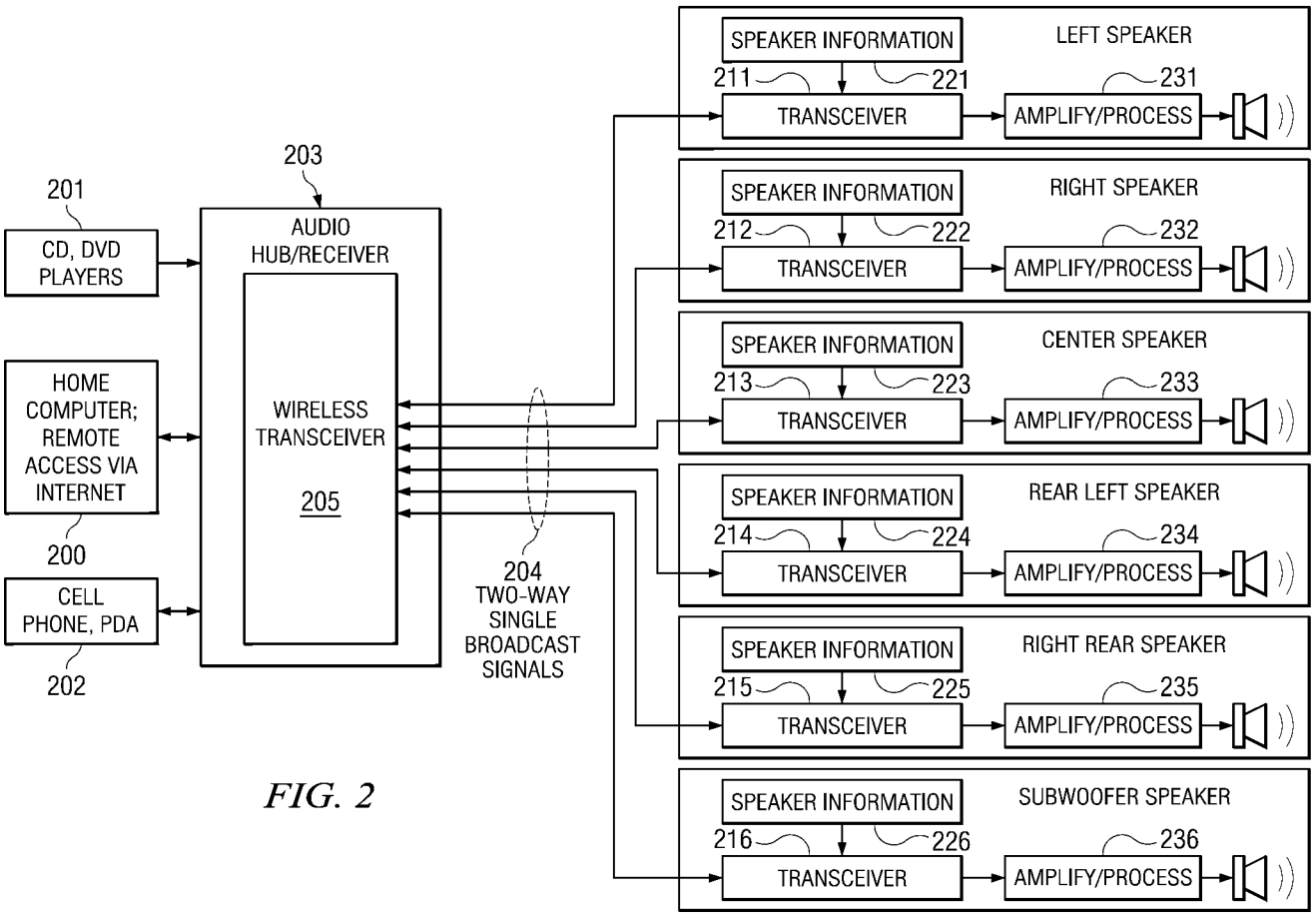
FIG. 2 illustrates the architecture of the preferred embodiment two-way wireless speaker system of this invention.

FIG. 2 illustrates the preferred embodiment of the two-way wireless speaker system of this invention. This system increases fidelity of the sound over the conventional one-way system of FIG. 1. Digital audio content can come from a home computer 200 or by remote access via the internet. A CD player or DVD player 201 provides another possible source and finally a cell phone or PDA 202 can be used. Digital audio is passed to the audio hub 203 where it is split into six components: left; right; center; rear left; rear right; and subwoofer. The wireless transceiver 205 modulates six separate carrier signals with the digital audio information. The six two-way broadcast signals 204 contain player content and reader identification. This is in contrast to one-way broadcasts, which are sent to all channels with each receiver extracting the broadcast signals (i.e. through frequency-division multiplexing or time-division multiplexing).

Using transceivers 211 through 216, speakers can acknowledge receipt of digital audio data packets. Speaker information is supplied by blocks 221 through 226. Amplify/process blocks 231 through 236 complete the processing of the signals to the speakers.

This methodology gives the preferred embodiment the following advantages:

Error correction is simplified and redundancy requirements are reduced;

Audio hub is allowed to achieve better synchronization among the speakers;

Increased functionality because the audio hub can receive data not only from wired inputs, but also wireless transmission from computers, cell phones, and other sources;

The audio hub (which usually has fixed functionality) can download audio algorithms/plug-ins from Internet (e.g. equalization, reverb and effects, acoustic environment analysis algorithms);

The audio hub can use information from a speaker to customize/adjust the audio signal for each speaker independently;

This allows easier setup than wired speakers, which require impedance matching with the audio hub;

This enables audio hub to scale audio signal for appropriate power level at speaker;

This also enables audio hub to perform equalization before transmission; and

With multiple drivers in a single speaker cabinet, information on drivers can be sent to the audio hub for digital prefiltering before transmission, thereby reducing cost of analog crossover circuits at each individual speaker.

Figure 3:
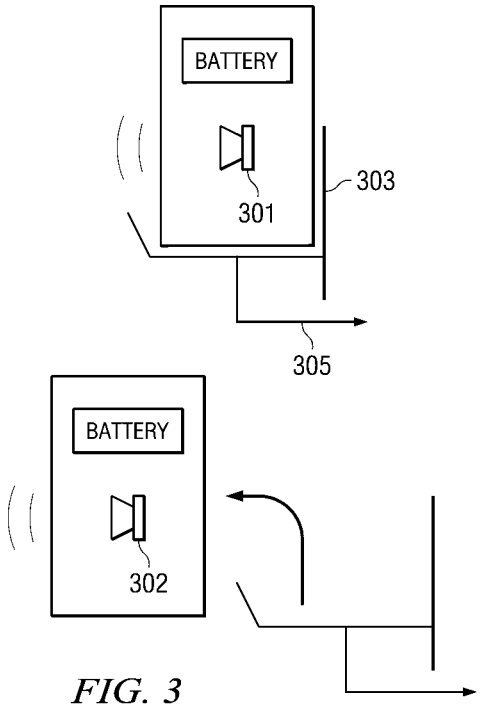
FIG. 3 illustrates the power distribution of the preferred embodiment two-way wireless speaker system of this invention.

FIG. 3 illustrates two power feed configurations for the two-way wireless speaker system of this invention. The audio hub can monitor the state of each speaker for low battery power indication. In this configuration, power for the speaker 301 is derived from the AC outlet 305 when this speaker is attached to bracket 303. When detached, speaker 302 uses its internal battery to power itself.

The following observations may be made:

Each speaker can be powered by battery or from an AC outlet;

Both types of power may be used in a detachable speaker configuration. This enables the user to take the music/speaker with him when moving to a new location within range of the wireless audio hub; and The available power status of a speaker can be communicated to the audio hub to influence audio data or control of speaker.

Figure 4:
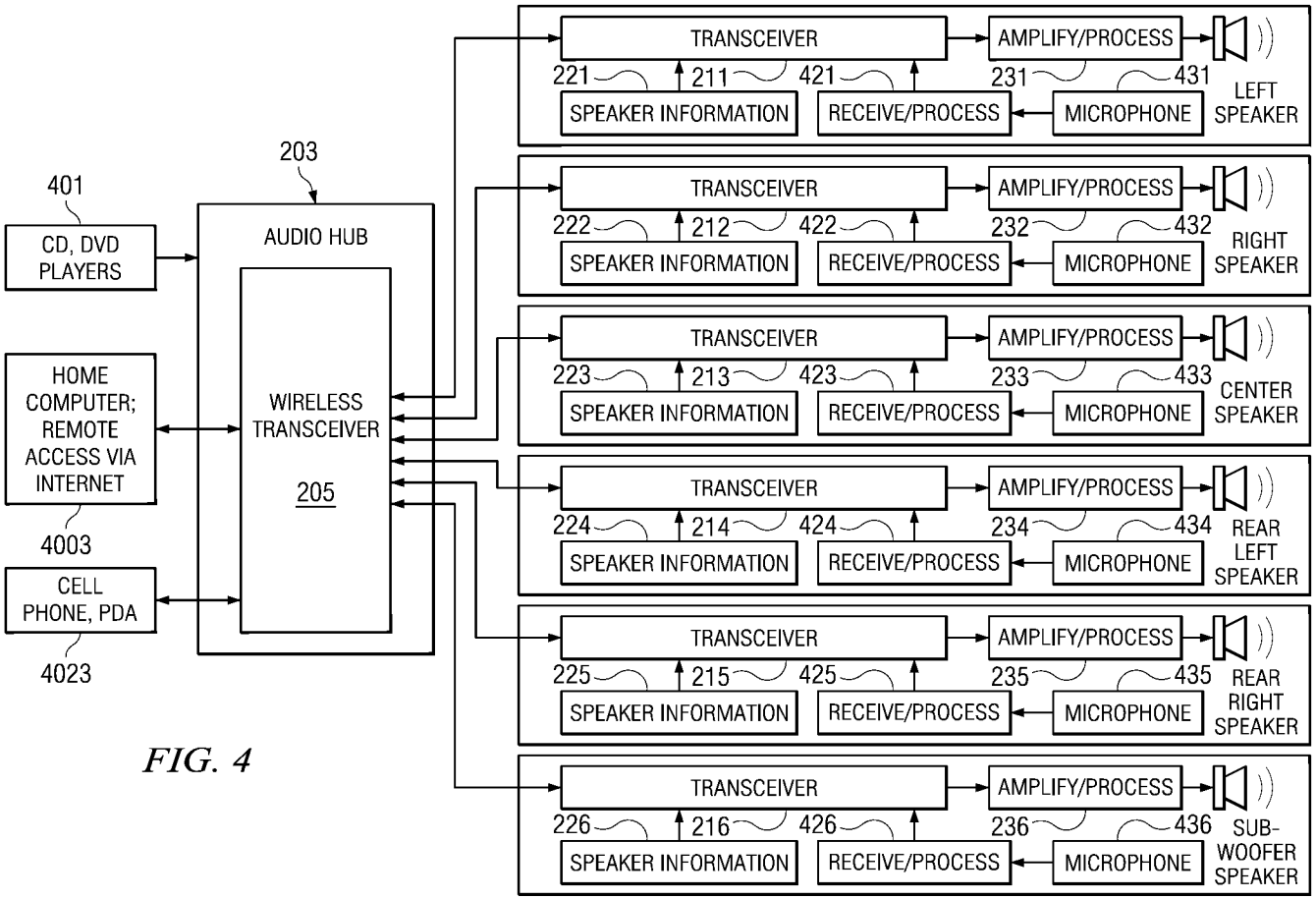
FIG. 4 illustrates the architecture of the second embodiment two-way wireless speaker system with microphone sensing of this invention.

FIG. 4 illustrates the second embodiment of this invention. It adds microphone inputs 431 through 436 to the basic first embodiment of FIG. 2, and it also utilizes receive/process elements 421 through 426 to gather the recording audio data. The other features of this second embodiment are similar to preferred embodiment of FIG. 2.

In this second embodiment to the invention, by adding microphones to each speaker the following upgrades may be made:

Easy speech transmission between different rooms in the home without a separate explicit intercom system allows an increase in the number of useful applications for home audio systems;

Telephone Ring can be detected indoors, and then relayed to outdoor speakers if home owner is outside of Room/Environment Detection;

If microphones detect that the ambient noise in room is high, the audio signal level can be increased via automatic gain control;

Improves surround sound capabilities of audio system and Surround sound teleconferencing. If an Acoustic Echo Cancellation (AEC) module is added at each speaker, this would enable full-duplex teleconferencing systems via the home theater;

Home security monitoring: Transient detection can trigger the monitoring by a power-sensitive camera system. This also allows recording of sounds by audio system, plus Notification of Home Owner or Security-Monitoring Company, in the case of an unexpected or dangerous event.

Figure 5:
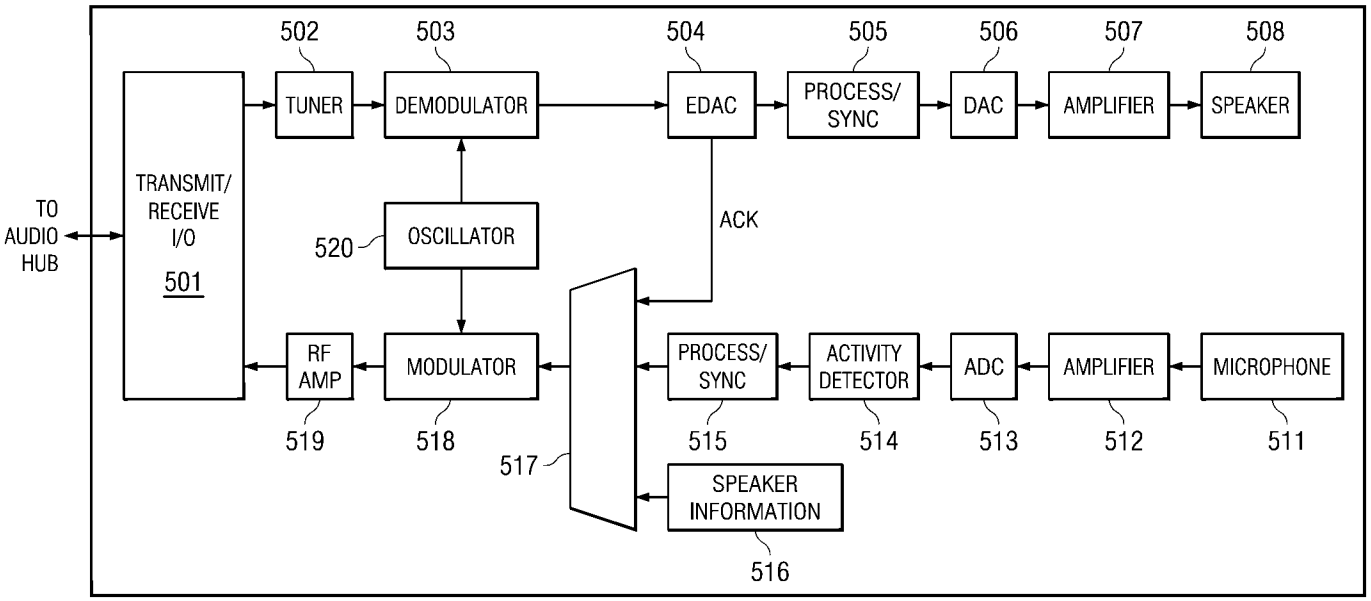
FIG. 5 illustrates details of the two-way architecture at each individual speaker in the wireless system.

FIG. 5 displays further details for implementing each individual speaker to attain the second embodiment. The transmit/receive I/O block 501 communicates with the audio hub, and the tuner 502 receives and extracts the analog signal for the channel. The particular tuning frequency could be set at the speaker via a knob on the speaker, but most likely would be negotiated with the audio hub upon initialization. The signal is then demodulated in block 503 to the audio frequency band and error corrected in 504 the error detection and correction EDAC. The EDAC block 504 will be responsible for sending acknowledgement messages back to the audio hub through mux 517, modulator 518, RF amp 519, and transmit/receive I/O block 501. The data output by the EDAC block 504 will contain both the audio data and the clock data to enable proper synchronization amongst many channels. The Process/Sync block 505 will receive both clock and audio data and buffer accordingly, only sending data to the DAC 506 at the proper presentation time. If any additional equalization or filtering are needed, it would also occur within Process/Sync block 505. After being converted to the analog domain by DAC 506, the signal is amplified (block 507) and played by Speaker 508.

If the second embodiment of FIG. 4 is implemented, then the speaker has microphone 511, amplifier 512, and ADC block 513 in order to pick up and digitize the audio environment. Activity detector 514 is used to listen for non-zero input from the auditory environment, and this would be important for the home monitoring application. Additionally, the resources and power for Process/Sync block 515 could be turned off when Activity Detector 514 sees no input. The process/sync block would perform any needed filtering and provide appropriate timestamps. Multiplexer 517 interleaves three data sources in preparation for transmission to the audio hub. First, it will take the audio and clock data from block 515 and microphone 511. Second, ACK messages from the EDAC 504 block need to be sent back to the audio hub. Lastly, information on the speaker status (e.g. current power source, battery level, etc.) needs to be sent to the audio hub from speaker information block 516. The Speaker Information block 516 is also utilized during initialization of the system to send characteristics (e.g. impedance, power rating, frequency response, playback latency, etc.) of the speaker to the audio hub. The remainder of the transmit path consists of the modulator 518 utilizing oscillator signal from block 520 and the RF amplifier 519 preparing the transmit signal for output.

Figure 6:
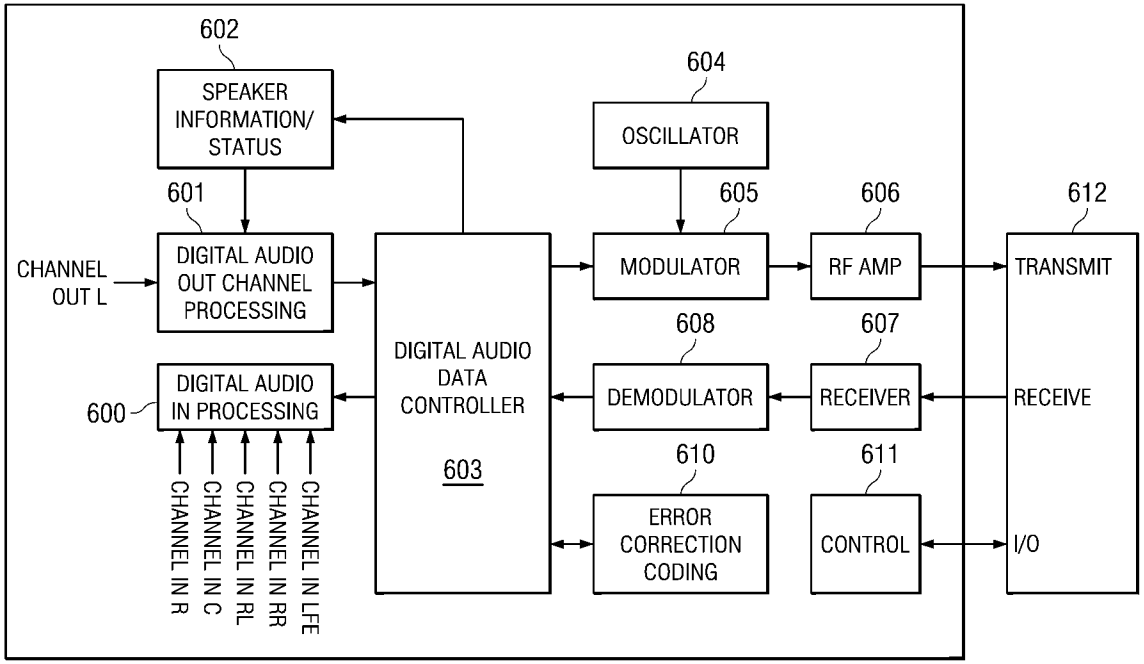
FIG. 6 displays the audio hub communication blocks for each single channel connected to this core of the two-way wireless audio system.

FIG. 6 displays the audio hub communication blocks for each single channel connected to this hub. A single output channel of audio will be sent through Digital Audio Out Channel Processing block 601, which will perform appropriate filtering based on the characteristics of the particular speaker (e.g. equalization for the speaker). This filtering is based upon the Speaker Information and Status block 602, which provides the speaker characteristics (e.g. number of drivers, frequency response, power rating, impedance, etc) and status (e.g. power level, on/off, location, etc.). This audio data is then buffered by the Digital Audio Data Controller 603, which will combine the audio data with necessary clock information. When this controller 603 has received acknowledgement of receipt of the previous audio block via I/O block 612, receiver 607 and demodulator 608, it will send the next audio block to the speaker using modulator 605, driven by oscillator 604, via RF Amplifier 606, and I/O block 612.

For reception of data from the speaker, the Digital Audio Data Controller 603 first uses Error Correction Coding block 610 to ensure proper reception. Following this, Controller 603 needs to parse the incoming data to separate acknowledgement messages from speaker status messages and recorded audio from the microphones. The speaker status messages are stored in Speaker Information/Status block 602 and recorded audio are sent to the Digital Audio In Processing block 600. This processing block can then take the recordings from multiple channels to perform analysis, which includes (but is not limited to):

1) Transient Detection for Home Monitoring;

2) Recording of Sounds for Home Monitoring;

3) Triangulation calculations for environmental source localization;

4) Acoustic room modeling;

5) Intra-house communication;

6) Loudness detection of environment; and

7) Surround sound teleconferencing.

Figure 7:
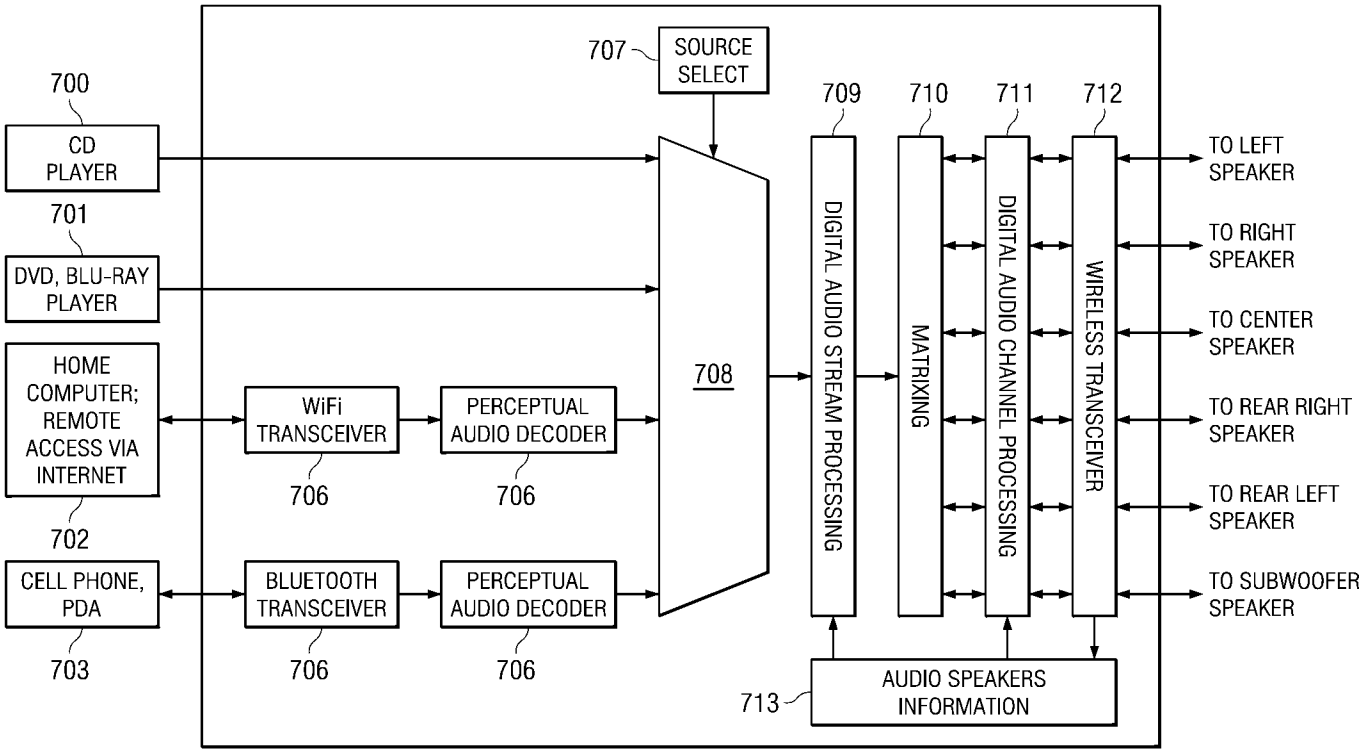
FIG. 7 illustrates the details of the various audio sources and processing for an audio hub in a two-way wireless speaker system.

FIG. 7 displays further details for implementing the various audio sources and processing for the audio hub to attain the preferred embodiment. A CD player 700 can provide digital stereo PCM audio data; a DVD or Blu-ray player 701 could provide digital multi-channel PCM audio data. Both these players are likely to be connected to the audio hub via a wired interface. On the other hand, the home computer 702 would likely connect wirelessly with a WiFi Access Point 704 on the audio hub. Audio from mobile sources like cell phone/PDA 703 could utilize WiFi or Bluetooth transceiver 705. Because wirelessly transmitted audio data is often sent in a perceptually-compressed format, Perceptual Audio Decoders 706 are needed to uncompress the stream to PCM data. These perceptual audio decoders needed would depend upon the files sent from the home computer 702 or cell phone 703, but a standard set would cover most cases: MPEG-1 Audio Layer 3 (MP3), MPEG-4 AAC, Windows Media Audio (WMA), and Bluetooth Sub-band coding (SBC). This allows inputs to the input mux 708 to all be in digital PCM format.

Source select 707 controls the input multiplexer 708, and if the source selection is not for a wireless input (i.e. home computer 702 or cell phone 703), then resources for WiFi transceiver 704 and Bluetooth transceiver 705 can be freed or powered down. Once a single source is playing, Digital Audio Stream Processing block 709 can perform audio filtering and processing that are identical for all output channels. An example of this would be global equalization of the output. The digital audio stream is then split into individual channels via the matrixing block 710. Because the audio hub knows about the characteristics of each individual wireless speaker (through communication via the wireless transceiver 712), this enables each individual channel to be filtered for each speaker (e.g. speaker-level equalization), and this is accomplished in the Digital Audio Channel Processing block 711. (Note that the Audio Channel Processing block 711 includes both Digital Audio Out Channel Processing block 601 and Digital Audio In Processing block 600 from FIG. 6.)

The wireless transceiver 712 converts each digital audio channel into the analog domain for transmission to the wireless speakers. (Note that wireless transceiver 712 can include many parts of FIG. 6: Digital Audio Data Controller 603, Oscillator 604, Modulator 605, RF Amp 606, Receiver 607, Demodulator 608, Error correction coding 610, Control block 611, and Transmit/Receive I/O block 612.) Ideally, a wireless transceiver would have similar capabilities to a WiFi Access Point, which handles multiple wireless channel links simultaneously; this would allow WiFi transceiver blocks 704 and 712 to then be combined. The wireless transceiver 712 sends the audio and clock data to each of the six speakers, and it looks for acknowledgement messages from each speaker. If transmission errors occur, packets can then be sent again while still adhering to latency constraints in the system. Additionally, speaker information and status are received from each speaker and stored in Speakers Information block 713 (note that Speakers Information block 713 encapsulates multiple channels of Speaker Information/Status block 602 in FIG. 6), and this information can be used to control digital audio channel processing block 711 and/or audio stream processing block 709. This model enables the audio hub to download plug-in algorithms to use within channel processing block 711 (e.g. driver crossover filtering, signal conditioning for improved power efficiency and impedance matching, etc.) or stream processing block 709 (e.g. room equalization, home monitoring, teleconferencing, etc.).

This invention makes provision for:

More intelligent audio speaker systems through shared knowledge of capabilities and status of each audio component;

Increased fidelity of audio transmission within system;

Availability of more input sources to audio system;

Capability of a usually static system to change over time (i.e. download of plug-ins); and Enabling intelligent system with detachable speakers.

The embodiment illustrated in FIGS. 4 and 5 provide the following additional advantages:

Enables more functionality in a system that is usually passive or often turned off completely;

Acoustic detection for room;

Environmental monitoring; and

Teleconferencing (half-duplex or full-duplex).

What is claimed is:

1. A two-way wireless speaker system comprising:

an audio hub/receiver including at least one source of multi-channel audio signals, and a wireless transceiver operable to wirelessly transmit an audio signal to each of a plurality of speaker units and wirelessly receive data from each speaker unit;

a plurality of speaker units, each speaker unit including a wireless transceiver operable to wirelessly receive an audio signal from said audio hub/receiver and wirelessly transmit data to said audio hub/receiver, an amplify/process unit connected to said wireless transceiver to amplify said received audio signal, a speaker connected to said amplify/process unit converting said amplified audio signal into a corresponding acoustic signal, a battery and an optional AC power input, each speaker unit powered by said battery if not connected to AC power, and a speaker information unit connected to said wireless transceiver generating speaker data corresponding to said speaker unit for transmitting said power source data to said audio hub/receiver indicating whether said corresponding speaker unit is powered by said AC power input or powered by said battery; and at least one speaker bracket operable to accommodate one of said plurality of speaker units, said at least one speaker bracket operable to deliver AC power to said AC power input when a speaker unit is attached.

2. The two-way wireless speaker system of claim 1, wherein:

said wireless transceiver of said audio hub/receiver is operable to transmit an audio signal to said at least one speaker unit corresponding to said speaker data of said at least one speaker unit.

3. The two-way wireless speaker system of claim 2, wherein;

said speaker data includes impedance of said at least one speaker unit.

4. The two-way wireless speaker system of claim 2, wherein;

said speaker data includes power rating data of said at least one speaker unit; and said speaker information unit further transmits said power rating data via said wireless transceiver to said audio hub/receiver.

5. The two-way wireless speaker system of claim 2, wherein;

said speaker data includes frequency response of said at least one speaker unit.

6. The two-way wireless speaker system of claim 2, wherein;

said speaker data includes playback latency data of said at least one speaker unit; and said speaker information unit further transmits said playback latency data via said wireless transceiver to said audio hub/receiver.

7. The two-way wireless speaker system of claim 1, wherein:

at least one speaker unit includes a multiple of drivers;

said speaker data is indicative of said multiple of drivers;

said wireless transceiver of said audio hub/receiver is operable to transmit an audio signal to said at least one speaker unit corresponding to said multiple of drivers of said at least one speaker unit.

8. The two-way wireless speaker system of claim 7, wherein:

said wireless transceiver of said audio hub/receiver is operable to transmit an audio signal to said at least one speaker unit including digital pre-filtering corresponding to said multiple of drivers.

9. A two-way wireless speaker system comprising:

a speaker unit including:

a wireless transceiver operable to wirelessly receive an audio signal and wirelessly transmit data, an amplify/process unit connected to said wireless transceiver to amplify said received audio signal, a speaker connected to said amplify/process unit converting said amplified audio signal into a corresponding acoustic signal, a battery and an optional AC power input, said speaker unit powered by said battery if not connected to AC power, and a speaker information unit connected to said wireless transceiver generating speaker data corresponding to said speaker unit for transmitting said power source data indicating whether said speaker unit is powered by said AC power input or powered by said battery; and a speaker bracket operable to accommodate said speaker unit, said speaker bracket operable to deliver AC power to said AC power input when said speaker unit is attached.

10. The speaker unit for a two-way wireless speaker system of claim 9, wherein;

said speaker data includes impedance of said at least one speaker unit.

11. The speaker unit for a two-way wireless speaker system of claim 9, wherein;

said speaker data includes power rating data of said at least one speaker unit; and said speaker information unit further transmits said power rating data via said wireless transceiver.

12. The speaker unit for a two-way wireless speaker system of claim 9, wherein;

said speaker data includes frequency response of said at least one speaker unit.

13. The speaker unit for a two-way wireless speaker system of claim 9, wherein;

said speaker data includes playback latency data of said at least one speaker unit; and said speaker information unit further transmits said playback latency data via said wireless transceiver.

14. The speaker unit for a two-way wireless speaker system of claim 9, wherein:

at speaker unit includes a multiple of drivers; and said speaker data is indicative of said multiple of drivers.

* * * * *